US008113631B2

(12) United States Patent
Shimizu et al.

(10) Patent No.: US 8,113,631 B2
(45) Date of Patent: Feb. 14, 2012

(54) LIQUID EJECTING HEAD

(75) Inventors: Yoichiro Shimizu, Kasugai (JP); Takao Hyakudome, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 371 days.

(21) Appl. No.: 12/536,323

(22) Filed: Aug. 5, 2009

(65) Prior Publication Data

US 2010/0073433 A1 Mar. 25, 2010

(30) Foreign Application Priority Data

Sep. 25, 2008 (JP) ..... 2008-245456

(51) Int. Cl.
*B41J 2/045* (2006.01)

(52) U.S. Cl. ..... 347/68; 347/17; 347/71

(58) Field of Classification Search ..... 347/6–65, 347/67–68, 70–71
See application file for complete search history.

(56) References Cited

U.S. PATENT DOCUMENTS

| | | | | |
|---|---|---|---|---|
| 7,121,649 | B2 * | 10/2006 | Chikamoto | 347/65 |
| 7,207,641 | B2 | 4/2007 | Komatsu et al. | |
| 7,213,911 | B2 * | 5/2007 | Taira | 347/68 |
| 2002/0130940 | A1 | 9/2002 | Suzuki et al. | |

FOREIGN PATENT DOCUMENTS

| | | | |
|---|---|---|---|
| JP | 2002-264362 | A | 9/2002 |
| JP | 2005-081597 | A | 3/2005 |
| JP | 2006-247841 | A | 9/2006 |

* cited by examiner

*Primary Examiner* — Juanita D Stephens
(74) *Attorney, Agent, or Firm* — Baker Botts L.L.P.

(57) ABSTRACT

A head for ejecting a liquid from ejection holes, including: a first flow-passage member in which is formed a first liquid-supply passage; a second flow-passage member in which is formed a second liquid-supply passage connected to the first passage and which has outflow ports for dispensing the liquid from the second passage; a third flow-passage member in which are formed (a) at least one common liquid passage each communicating with at least one of the outflow ports and (b) individual liquid passages; and at least one energy giving member, wherein the first member, the second member, and the third member are superposed in this order on each other, and wherein the head further comprises a heater disposed between one surface of the first member that faces the second member and facing surface of the second member as one surface thereof that faces the first member.

22 Claims, 10 Drawing Sheets

LIQUID EJECTING HEAD

CROSS REFERENCE TO RELATED APPLICATION

The present application claims priority from Japanese Patent Application No. 2008-245456, which was filed on Sep. 25, 2008, the disclosure of which is herein incorporated by reference in its entirety.

BACKGROUND OF THE INVENTION

1. Field of the Invention

The present invention relates in general to a liquid ejecting head for ejecting a liquid therefrom.

2. Description of the Related Art

The viscosity of a liquid such as ink ejected from a liquid ejecting head varies depending upon the temperature of the liquid. In general, the viscosity of the liquid is increased under a low temperature condition. Accordingly, under the low temperature condition, a resistance against a flow of the liquid at a time when the liquid flows into a pressure chamber becomes large, so that it is difficult to obtain a satisfactory ejection effect even if a drive frequency is increased. Further, in order to obtain, under the low temperature condition, the same ejection characteristic (including the ejection amount and the ejection speed) as obtained under an ordinary temperature condition, it is needed to give, to the liquid in the pressure chamber, ejection energy larger than that given under the ordinary temperature condition, by increasing a drive voltage. In this instance, however, it is needed to increase a withstand voltage of an actuator configured to give the ejection energy to the liquid in the head and a withstand voltage of a driver IC configured to drive the actuator. Thus, ejection of the liquid having high viscosity entails some difficulty.

In view of the above, the following Patent Document 1 discloses an ink-jet recording apparatus in which a sub tank, an ink supply pipe connecting the sub tank and a head chip, and a flow-passage substrate provided on the head chip are provided with respective heating devices, for the purpose of lowering the viscosity of the ink under the low temperature condition.

Patent Document 1: JP-A-2002-264362

SUMMARY OF THE INVENTION

The ink-jet recording apparatus disclosed in the above-indicated Patent Document 1 is provided with the three heating devices, and one of the three heating devices is disposed outside the head chip, rendering the structure of the apparatus complicated. Further, even though the heating device is disposed on the upper surface of the flow-passage substrate, it is impossible to effectively warm the ink in the head chip, so that the viscosity of the ink in the head cannot be sufficiently lowered.

A need has arisen for a liquid ejecting head capable of effectively warming a liquid that flows thereinto.

According to one embodiment herein, a liquid ejecting head for ejecting a liquid from a plurality of ejection holes may comprise: a first flow-passage member in which is formed a first liquid-supply passage to which the liquid is supplied from an exterior of the liquid ejecting head; a second flow-passage member in which is formed a second liquid-supply passage connected to the first liquid-supply passage and which has a plurality of outflow ports for dispensing the liquid from the second liquid-supply passage; a third flow-passage member in which are formed (a) at least one common liquid passage each communicating with at least one of the plurality of outflow ports of the second flow-passage member and (b) a plurality of individual liquid passages which are provided so as to respectively correspond to the plurality of ejection holes, each of which is connected to any one of the at least one common liquid passage, and which respectively have pressure chambers formed therein, each of the plurality of individual liquid passages introducing the liquid to a corresponding one of the plurality of ejection holes via a corresponding one of the pressure chambers; and at least one energy giving member configured to give ejection energy to the liquid in each of the pressure chambers that are formed respectively in the plurality of individual liquid passages, wherein the first flow-passage member, the second flow-passage member, and the third flow-passage member are superposed in this order on each other, and wherein the liquid ejecting head further comprises a heater disposed between one surface of the first flow-passage member that faces the second flow-passage member and facing surface of the second flow-passage member as one surface thereof that faces the first flow-passage member.

In the liquid ejecting head described above, the liquid in the head can be effectively warmed by the heater disposed between the one surface of the first flow-passage member and the facing surface of the second flow-passage member which faces that one surface, whereby the viscosity of the liquid in the head can be sufficiently lowered.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE EMBODIMENT

Figure 1:
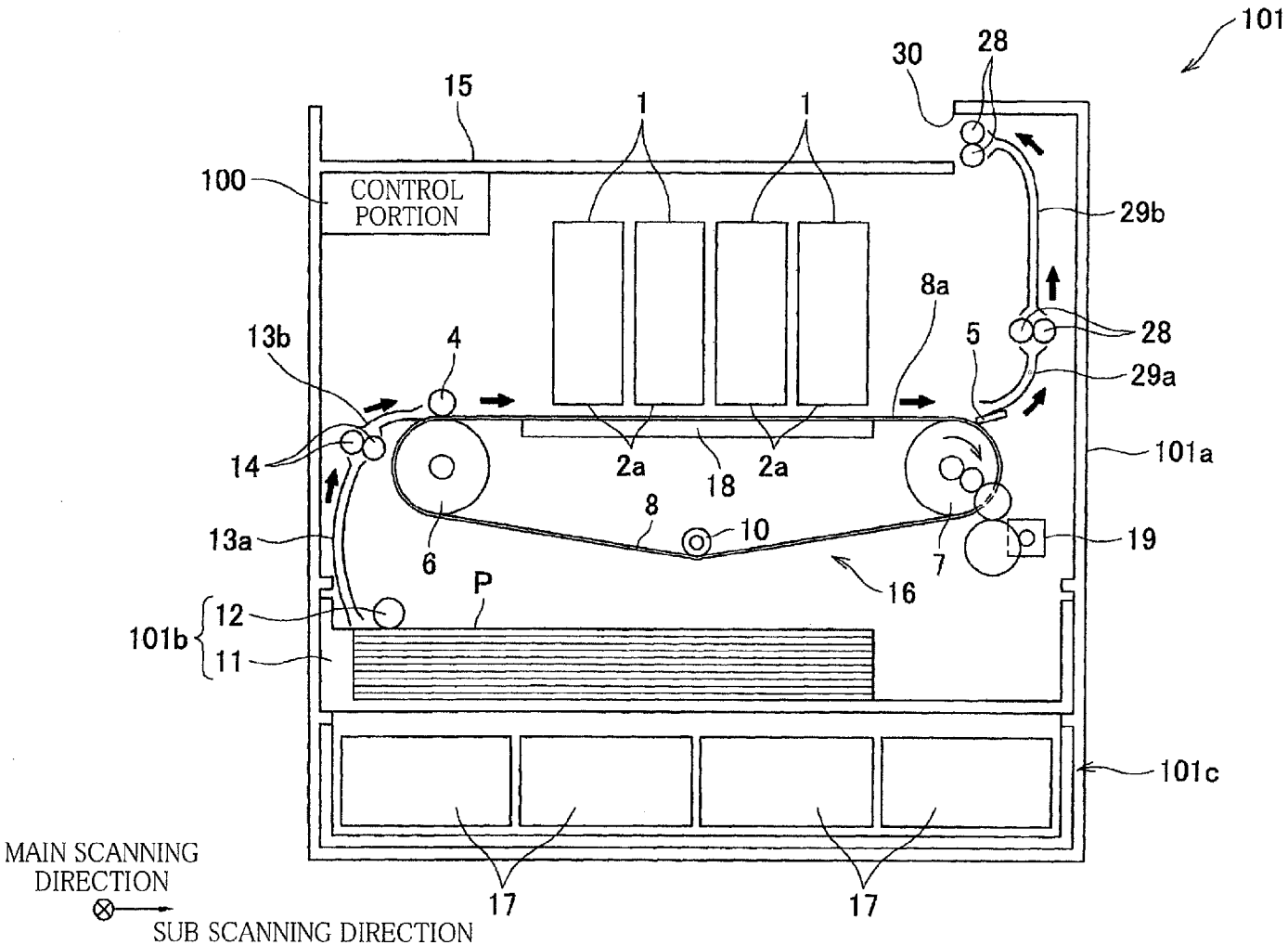
FIG. 1 is a vertical cross sectional view showing an internal structure of an ink-jet printer including an ink-jet head according to one embodiment of the invention.

Referring to the drawings, there will be explained an embodiment of the present invention.

FIG. 1 shows an internal structure of an ink-jet printer including an ink-jet head as a liquid ejecting head according to one embodiment of the invention. As shown in FIG. 1, the ink-jet printer generally indicated at 101 in FIG. 1 has a casing

101*a* having a rectangular parallelepiped shape. In the casing 101*a*, there are disposed: four ink-jet heads 1 which respectively eject magenta ink, cyan ink, yellow ink, and black ink; and a sheet conveying mechanism 16. On the inner surface of the top plate of the casing 101*a*, a control portion 100 for controlling operations of the ink-jet heads 1 and the sheet conveying mechanism 16 is attached. A sheet-supply unit 101*b* is disposed below the sheet conveying mechanism 16. The sheet-supply unit 101*b* is removably attached to the casing 101*a*. Below the sheet-supply unit 101*b*, an ink tank unit 101*c* is disposed so as to be detachable from the casing 101*a*.

In the ink-jet printer 101, there is formed a sheet delivery path through which a sheet P is delivered along solid arrows in FIG. 1 from the sheet-supply unit 101*b* toward a sheet receiving recessed portion 15. The sheet-supply unit 101*b* includes: a sheet tray 11 having a box-like shape opening upward and accommodating a stack of the sheets P; and a sheet-supply roller 12 configured to supply an uppermost one of the sheets P accommodated in the sheet tray 11. The sheet P supplied from the sheet tray 11 by the sheet-supply roller 12 is delivered to the sheet conveying mechanism 16 while being guided by sheet guides 13*a*, 13*b* and nipped by rollers of a feed roller pair 14.

The sheet conveying mechanism 16 includes: two belt rollers 6, 7; an endless sheet conveyor belt 8 wound around the two rollers 6, 7 so as to be stretched therebetween; a tension roller 10 which is in contact with the inner circumferential surface of the sheet conveyor belt 8 at the lower half portion of the loop of the sheet conveyor belt 8 while being biased downwardly, thereby applying tension to the sheet conveyor belt 8; and a platen 18 which is disposed in a region enclosed by the sheet conveyor belt 8. The platen 18 supports, at a position where the platen 18 is opposed to the ink-jet heads 1, the sheet conveyor belt 8 so as to prevent the sheet conveyor belt 8 from sagging downward. The belt roller 7 is a drive roller configured to be rotated clockwise in FIG. 1 by a drive force given to its shaft from a sheet delivery motor 19. The belt roller 6 is a driven roller configured to be rotated clockwise in FIG. 1 by the movement of the sheet conveyor belt 8 in accordance with rotation of the belt roller 7. The drive force of the sheet delivery motor 19 is transmitted to the belt roller 7 through a plurality of gears.

The outer circumferential surface 8*a* of the sheet conveyor belt 8 is silicone-treated so as to have adhesion property. A nip roller 4 is disposed at a position on the sheet delivery path at which the nip roller 4 faces the belt roller 6 with the sheet conveyor belt 8 interposed therebetween. The nip roller 4 is configured to press the sheet P supplied from the sheet-supply unit 101*b* onto the outer circumferential surface 8*a* of the sheet conveyor belt 8. The sheet P pressed onto the outer circumferential surface 8*a* of the sheet conveyor belt 8 is conveyed in a sheet conveyance direction, namely, in a sub scanning direction, (in the rightward direction in FIG. 1) while being held on the outer circumferential surface 8*s* of the sheet conveyor belt 8 owing to its adhesion property.

A separation plate 5 is disposed at a position on the sheet delivery path where the separation plate 5 faces the belt roller 7. The separation plate 5 separates the sheet P held on the outer circumferential surface 8*a* of the sheet conveyor belt 8 therefrom. The separated sheet P is delivered upward while being guided by sheet guides 29*a*, 29*b* and nipped by rollers of each of two feed roller pairs 28. Subsequently, the sheep P is ejected from an outlet 30 formed at the upper portion of the casing 101*a* to the sheet receiving recessed portion 15 formed on the upper surface of the casing 101*a*.

The four ink-jet heads 1 respectively eject inks of the mutually different colors, i.e., magenta, yellow, cyan, and black. Each ink-jet head 1 has a generally rectangular parallelepiped shape having a longer dimension in a main scanning direction that is perpendicular to the sub scanning direction. The dimension of each head 1 as measured in the main scanning direction is larger than the width of the sheet. The four ink-jet heads 1 are arranged side by side in the sheet conveyance direction and immovable in the main scanning direction. That is, the ink jet printer 101 is a printer of a line type.

The bottom surface of each ink-jet head 1 is made as an ejection surface 2*a* in which are formed a plurality of ejection holes 108 (FIG. 9) through which the ink is ejected. When the sheet P being conveyed passes right below the four ink-jet heads 1, the inks of the different colors are ejected from the ejection holes 108 toward the upper surface of the sheet P, whereby an intended color image is formed on the upper surface, i.e., on the print surface, of the sheet P.

The four ink-jet heads 1 are connected respectively to four ink tanks 17 disposed in the ink tank unit 101*c*. The inks of the mutually different four colors are stored in the respective four ink tanks 17. The inks are supplied from the ink tanks 17 to the respective ink-jet heads 1 via respective tubes.

Figure 2:
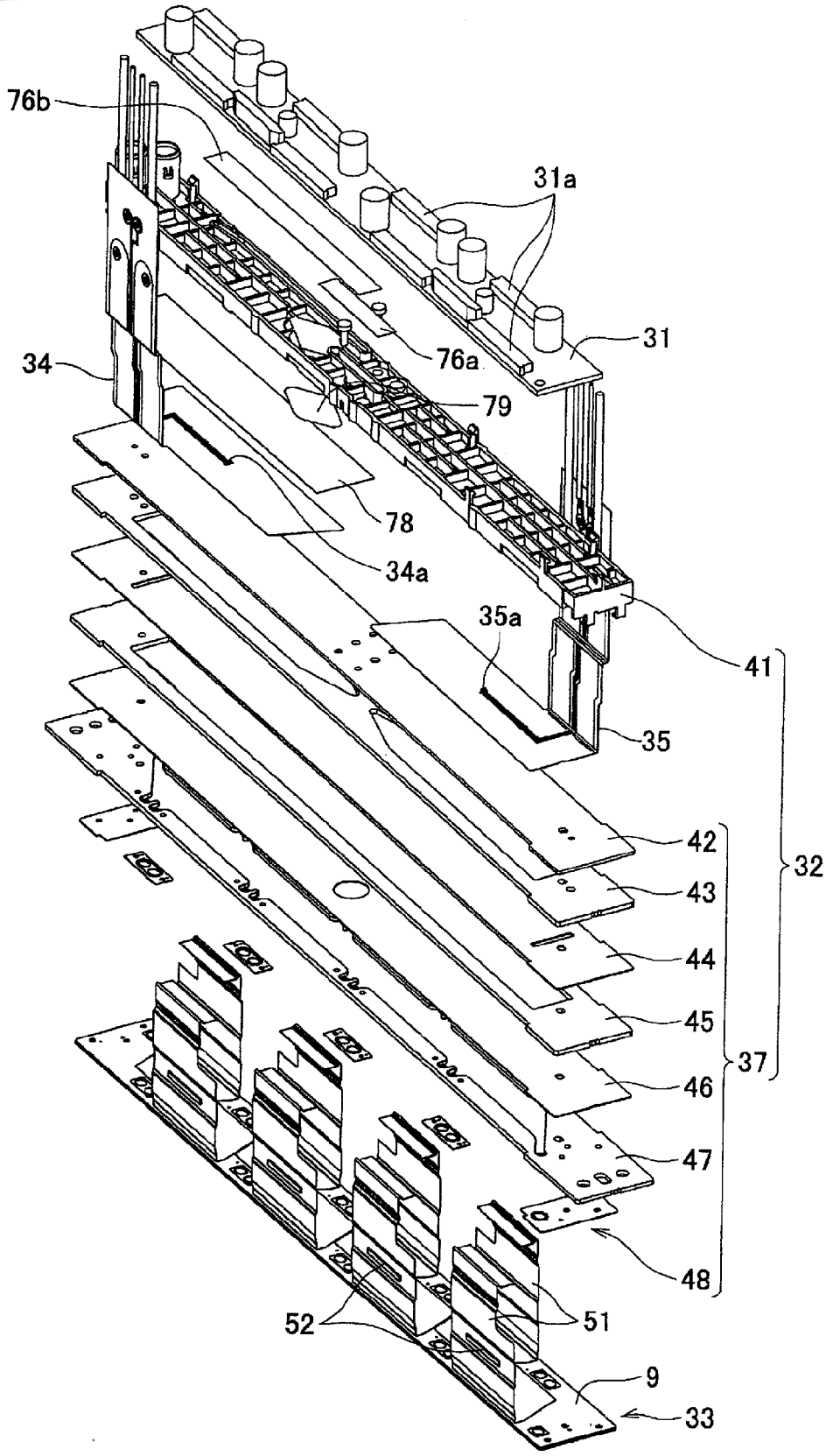
FIG. 2 is an exploded perspective view of the ink-jet head of FIG. 1.
Figure 3:
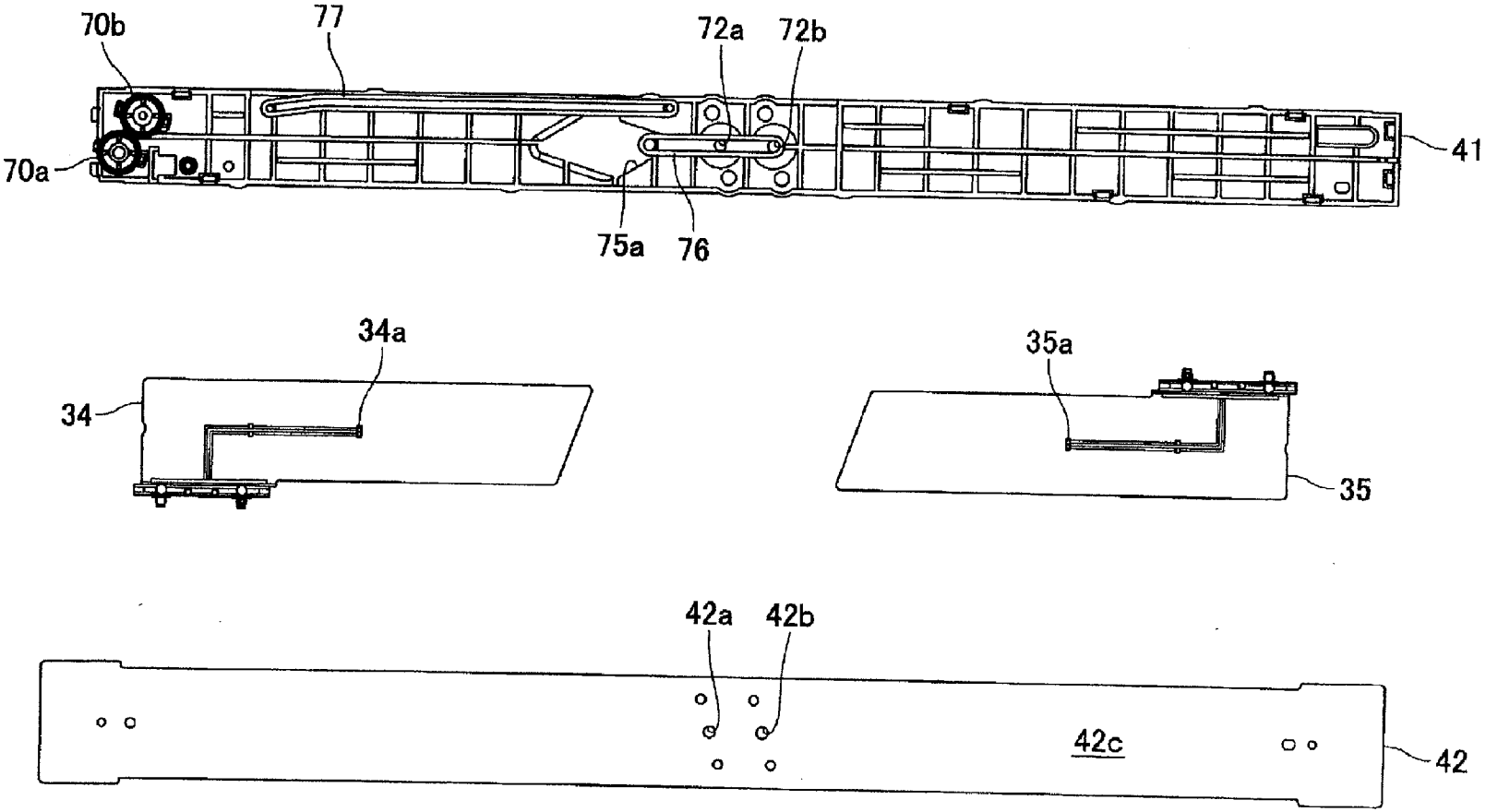
FIG. 3 is a plan view of a part of a plurality of plates constituting the ink-jet head of FIG. 1.
Figure 4:
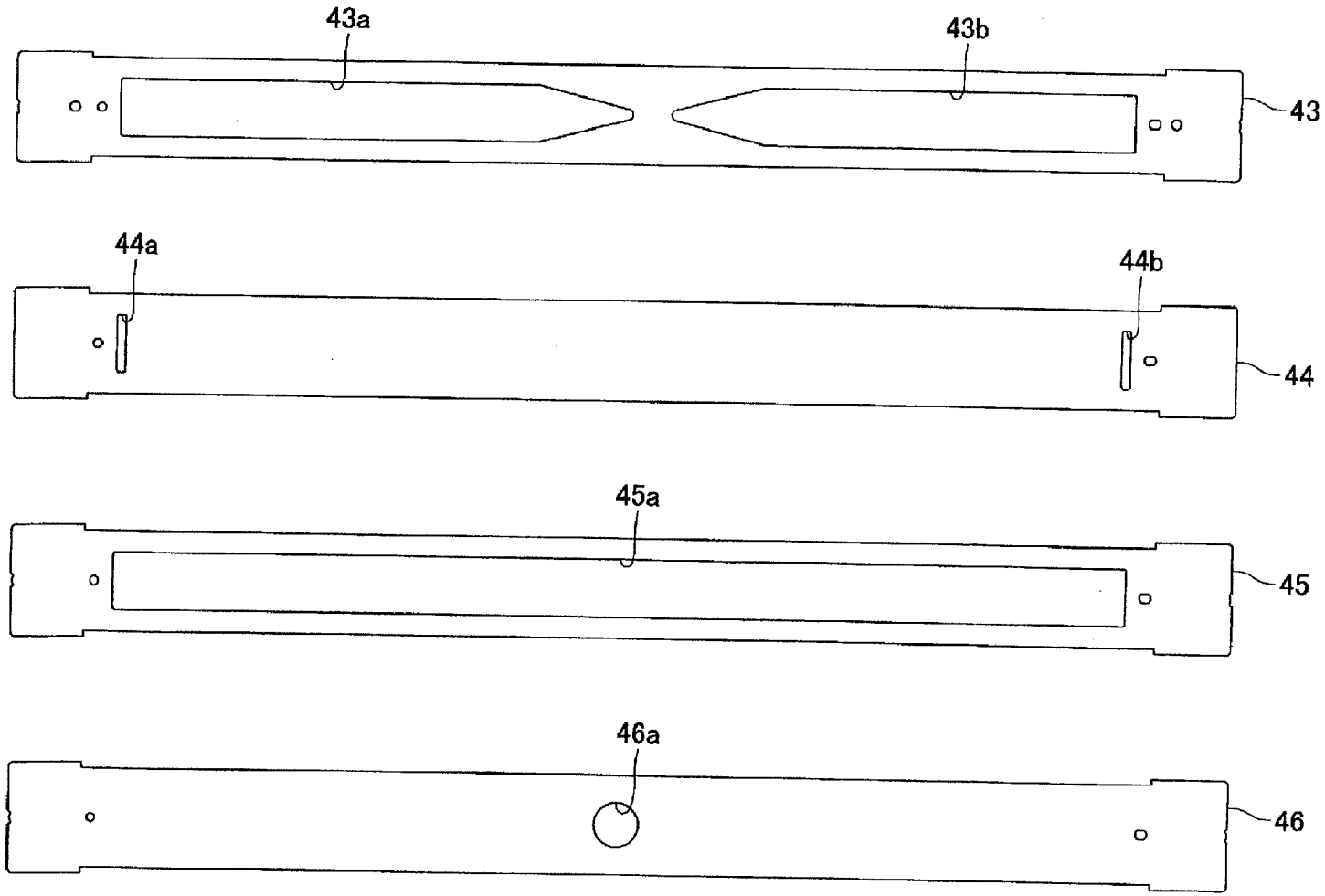
FIG. 4 is a plan view of a part of the plurality of plates constituting the ink-jet head of FIG. 1.
Figure 5:
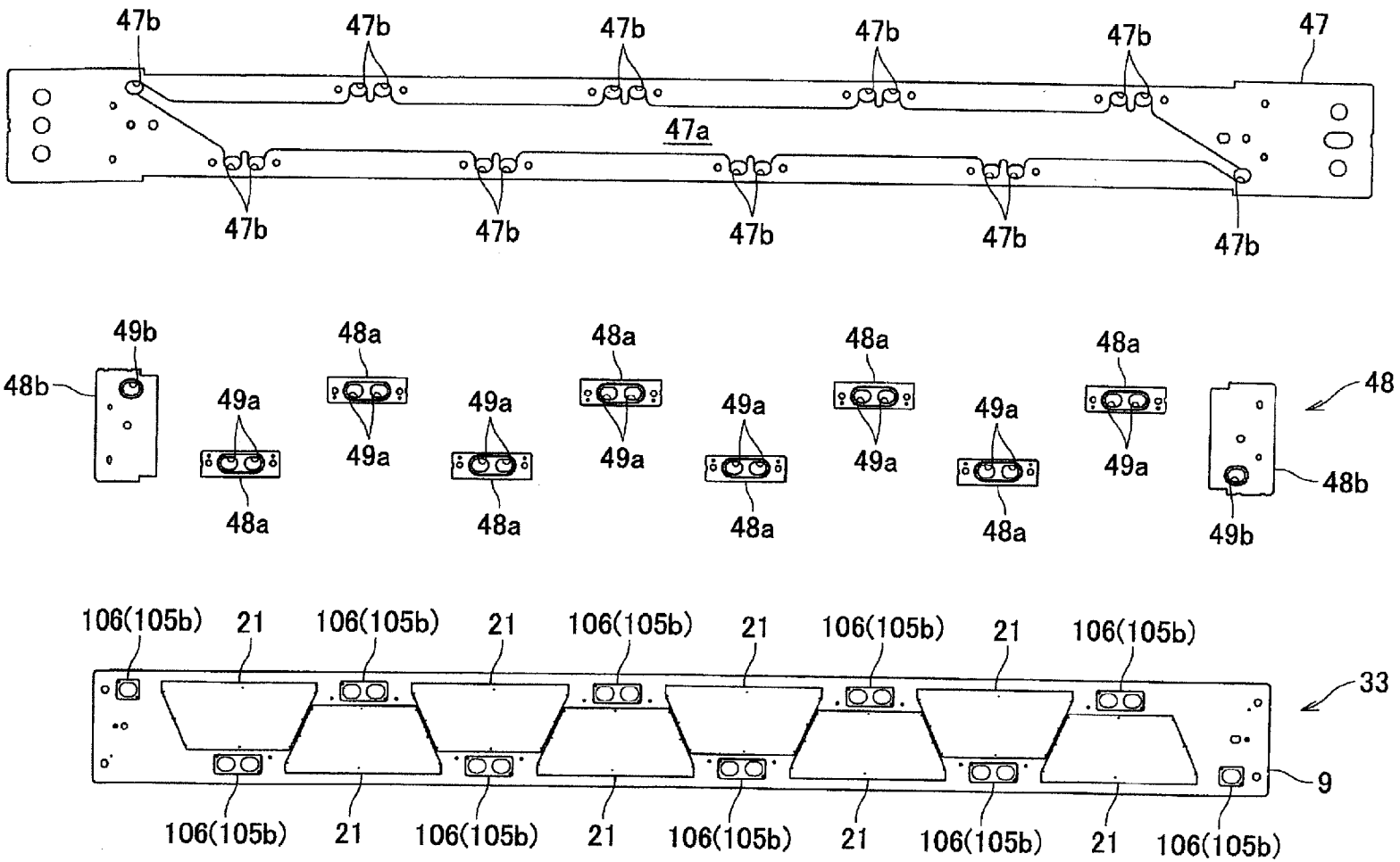
FIG. 5 is a plan view of a part of the plurality of plates constituting the ink-jet head of FIG. 1.

FIG. 2 is an exploded perspective view of the ink-jet head 1. As shown in FIG. 2, the ink-jet head 1 includes: a base plate 31; a reservoir unit 32 that includes a first flow-passage member and a second flow-passage member; a head main body 33 that includes a flow-passage unit 9 as a third flow-passage member; and two sheet-like heaters 34, 35. FIGS. 3-5 are plan views showing a plurality of components constituting the head 1, except for the base plate 31 and a COF 51 that will be explained. As shown in FIGS. 2-5, the reservoir unit 32 is constituted by: a laminar body 37 including six plates 42-47 and a small-plate group 48; and a filter support member 41 that is fixed to the upper surface of the laminar body 37. The small-plate group 48 consists of eight inner small plates 48*a* and two outer small plates 48*b*.

Referring to the cross sectional view of FIG. 6, the filter support member 41 as the first flow-passage member will be explained. The filter support member 41 is formed by integral molding of a resin material. In the filter support member 41, there is formed a first liquid-supply passage to which the ink is supplied from the ink tank 17. Two cylindrical projections 70*a*, 70*b* project upward from an upper surface 70*f* of the filter support member 41. A vertically extending inlet 71 is formed in the cylindrical projection 70*a*. To the cylindrical projection 70*a*, a flexible tube is attached, and the ink in the ink tank 17 as an ink supply source is introduced into the filter support member 41 from the inlet 71 via the tube.

There is formed, in the filter support member 41, an ink flow passage 73 as the first liquid-supply passage that includes the vertically extending inlet 71 in which an ink inlet opening is formed and two vertically extending outlets 72*a*, 72*b* in each of which an ink outlet opening is formed. The ink flow passage 73 includes an intermediate portion 93 between the inlet 71 and the two outlets 72*a*, 72*b*. In the intermediate portion 93, there is formed an elongate, rectangular opening 74*a* opening downward.

To the filter support member 41, there is attached a filter 79 in which a plurality of minute through-holes are formed for filtering the ink. The filter 79 divides the intermediate portion 93 into: a first space 74 which is held in communication with the inlet 71 and which is defined by the rectangular opening 74*a*; and a second space 75 which is held in communication with the outlets 72*a*, 72*b*. A region of the second space 75 which does not face the filter 79, i.e., a non-facing region 76, horizontally extends at a height level that is slightly higher than a height level of a region of the second space 75 which faces the filter 79. The two outlets 72*a*, 72*b* extend from the non-facing region 76 in the vertically downward direction so as to open to a lower surface 70*e* of the filter support member 41.

The first space 74 has an elongate, rectangular shape. The opening 74*a* is sealed by a damper film 78 as a seal member. The damper film 78 has generally the same shape as the opening 74*a* in plan view. Thus, the damper film 78 cooperates with the filter support member 41 to define the ink flow passage 73. A peripheral wall 74*b* that defines the opening 74*a* extends downward to a predetermined height level throughout its periphery, so that the damper film 78 fixed to the lower end of the peripheral wall 74*b* extends horizontally.

In the second space 75, a downward opening 75*a* is defined by a recess. The opening 75*a* faces a part of the damper film 78 that extends from a position on a right side of the center of the damper film 78 to the right-side end of the same 78. The opening 75*a* has a shape, in plan view, that tapers in both of a direction of the ink flow and a direction opposite to the ink flow direction. The filter 79 has a shape substantially similar to that of the opening 75*a* and has a size in plan view somewhat larger than the opening 75*a*. The filter 79 is fixed in the first space 74 so as to cover the opening 75*a*. In other words, the filter 79 is fixed to the filter support member 41 so as to be opposed to the opening 74*a* and the damper film 78.

Figure 6:
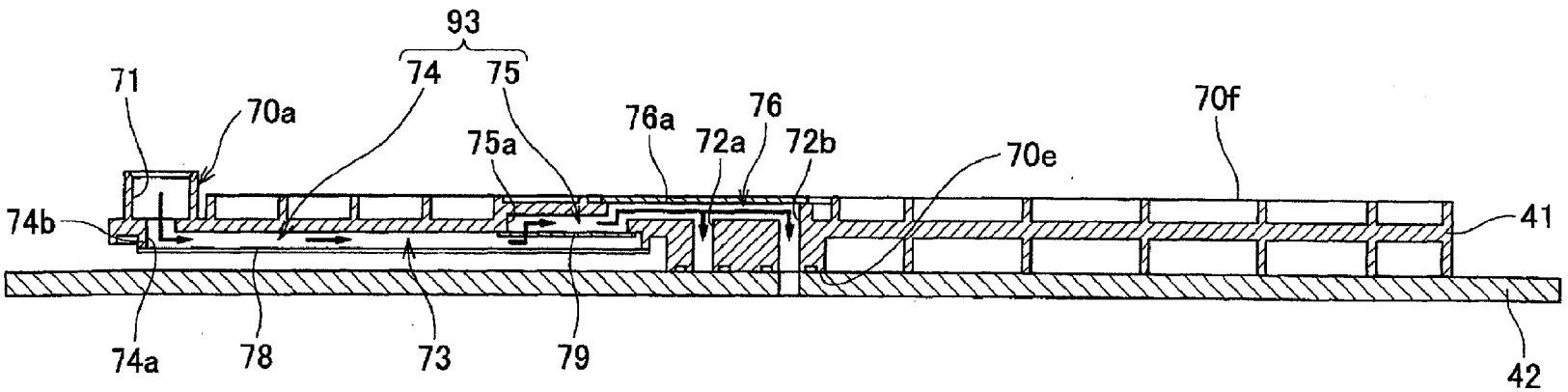
FIG. 6 is a cross sectional view of a filter support member included in the ink-jet head.

The ink introduced from the inlet 71 initially flows substantially horizontally in the first space 74 from the left to the right in FIG. 6, then reaches the region of the first space facing the filter 79, and flows upward through the filter 79. Subsequently, the ink flows into the second space 75 through the filter 79. In this occasion, foreign substances present in the ink flowed from the first space 74 are caught by the filter 79, and the ink from which the foreign substances have been removed by the filter 79 flows in the second space 75. After the ink has flowed in the non-facing region 76 of the second space 75, the ink flows downward through the outlets 72*a*, 72*b* and is finally discharged into the plate 42.

The damper film 78 is a flexible resin film. Between the damper film 78 and the upper surface of the plate 42, there is formed a clearance that allows deflection of the damper film 78 in accordance with vibration of the ink. According to the structure described above, the damper film 78 is deflected in the substantially vertical direction in accordance with the vibration of the ink, whereby the vibration of the ink can be absorbed and damped.

An opening is formed in an upper surface 70*f* of the filter support member 41 to define the non-facing region 76. The opening is sealed by a film 76*a* having flexibility, and the film 76*a* is deflected in accordance with the vibration of the ink, whereby the vibration of the ink is absorbed and damped.

In the filter support member 41, there is further formed a discharge passage connecting the first space 74 and an outlet opening of the cylindrical projection 70*b*. The discharge passage initially extends below the non-facing region 76 in the width direction of the filter support member 41, then extends in the longitudinal direction of the filter support member 41 after having extended upward to the same height level as the non-facing region 76, and finally communicates with the cylindrical projection 70*b* on the downstream side of a position at which the discharge passage comes down to a height level lower than the filter 79. A region 77 having the same height level as the non-facing region 76 is defined by sealing an opening formed in the upper surface 70*f* of the filter support member 41 with a film 76*b*. The discharge passage is utilized for discharging air bubbles staying in a portion of the filter support member 41 located on the upstream side of the filter 79.

The laminar body 37 including the plates 42-47 and the small-plate group 48 constitutes the second flow-passage member. Each of the plates of the laminar body 37 is formed of a metal material having a higher degree of heat conductivity than the resin material of the filter support member 41. In the plates of the laminar body 37, there are formed through-holes, openings, and a recess which provide the second liquid-supply passage and eighteen outflow ports described below.

More specifically, two through-holes 42*a*, 42*b* are formed through the thickness of the plate 42 in the vicinity of the central portion of the same 42, so as to be opposed to the inlets 72*a*, 72*b*, respectively. The two through-holes 42*a*, 42*b* are connected to the ink flow passage 73 as the first liquid-supply passage. The upper surface of the plate 42 faces the lower surface 70*e* of the filter support member 41. In the following description, the upper surface of the plate 42 is referred to as a "facing surface".

Two openings 43*a*, 43*b* are formed through the thickness of the plate 43. The opening 43*a* extends from the vicinity of the central portion of the plate 43 to one of longitudinal ends of the same 43 while the opening 43*a* extends from the vicinity of the central portion of the plate 43 to the other of the longitudinal ends of the same 43. Each opening 43*a*, 43*b* has a tapered section that tapers in a direction toward the central portion of the plate 43. The openings 43*a*, 43*b* are opposed, around ends of the respective tapered sections, to the through-holes 42*a*, 42*b*, respectively. Two through-holes 44*a*, 44*b* are formed through the thickness of the plate 44 so as to be located at respective longitudinal end portions of the plate 44. The through-holes 44*a*, 44*b* are respectively opposed to outer ends of the respective openings 43*a*, 43*b*.

An elongate, rectangular opening 45*a* is formed through the thickness of the plate 45 so as to extend from one of longitudinal end portions of the plate 45 to the other of the longitudinal end portions thereof. The opening 45*a* is opposed, at its longitudinally opposite ends, to the respective through-holes 44*a*, 44*b*. A circular through-hole 46*a* is formed through the thickness of the plate 46 around the central portion of the same 46. The through-hole 46 has a diameter slightly smaller than the width of the opening 45*a* and is opposed to the central portion of the opening 45*a*.

An elongate recess 47*a* is formed in the plate 47 so as to extend from one of longitudinal end portions of the plate 47 to the other of the longitudinal end portions of the same 47. The central portion of the recess 47*a* is opposed to the circular opening 46*a*. The recess 47*a* is formed by etching a substantially upper half portion of the plate 47 in its thickness direction.

In addition to the recess 47*a*, eighteen through-holes 47*b* are formed through the thickness of the plate 47 so as to be located within the recess 47*a*. More specifically, the eighteen through-holes 47*b* are located so as to be contiguous to the periphery of the recess 47*a* and are arranged, along the longitudinal direction of the plate 47, in two rows each consisting of nine through-holes 47*b*. The nine through-holes 47*b* in each of the two rows are disposed such that eight through-holes 47*b* except for the outermost one of the through-holes 47*b* form four pairs. Each pair consists of two through-holes 47*a* that are located adjacent to each other. Further, the eighteen through-holes 47*b* are disposed so as to have point symmetry with respect to the center of the plate 47.

In each of eight inner small plates 48*a* in the small-plate group 48, there are formed two through-holes 49*a* which are to be opposed to corresponding two adjacent through-holes 47*b* of the plate 47. In each of two outer small plates 49*b* between which the eight inner small plates 48*a* are disposed, one through-hole 49*b* is formed so as to be opposed to a corresponding one of the outermost through-holes 47*b* in the plate 47.

In the present embodiment, the second liquid-supply passage is constituted by the through-holes 42*a*, 42*b* formed in the plate 42; the openings 43*a*, 43*b* formed in the plate 43; the through-holes 44*a*, 44*b* formed in the plate 44; the opening 45*a* formed in the plate 45; the through-hole 46*a* formed in the plate 46; and recess 47*a* formed in the plate 47, which are in communication with each other. The through-holes 47*b* in the plate 47 and the through-holes 49*a*, 49*b* in the plate 48 constitute a plurality of outflow ports connected to the second liquid-supply passage. More specifically, each outflow port is constituted by a combination of the through-hole 47*b* formed in the plate 47 and the through-hole 48*a* formed in a corresponding small plate 48*a* or the through-hole 49*b* formed in a corresponding small palate 48*b*. Each outflow port is connected to a corresponding manifold 105 in the flow-passage unit 9 via a corresponding ink supply hole 105*b* described below.

The two heaters 34, 35 are fixed to the facing surface 42*c* of the plate 42 so as to be in contact therewith. The length of each heater 34, as measured in the longitudinal direction of each of the plates 42-47 is not larger than half the length of each of the plates 42-47 as measured in the same direction. Each heater 34, 35 has a generally rectangular shape that extends in the longitudinal direction of the reservoir unit 32, and is disposed on the facing surface 42*c* such that the longitudinal direction of each heater 34, 35 coincides with the longitudinal direction of the reservoir unit 32. A mid point between a line connecting the two heaters 34, 35 coincides with the center of the laminar body 37, as the second flow-passage member, that includes the plates 42-47 and the small-plate group 48. The arrangement reduces a variation in the temperature in the head 1, thereby reducing a variation in the temperature of the ink. Accordingly, it is possible to minimize nonuniformity in the printed image.

The head main body 33 includes the flow-passage unit 9, ten filters 106, and eight actuator units 21. The filters 106 and the actuator units 21 are fixed to the upper surface of the flow-passage unit 9. Each filter 106 is provided for a corresponding one of the ten small plates 48*a*, 48*b*, and covers one or two ink supply holes 105*b* which will be explained.

Figure 9:
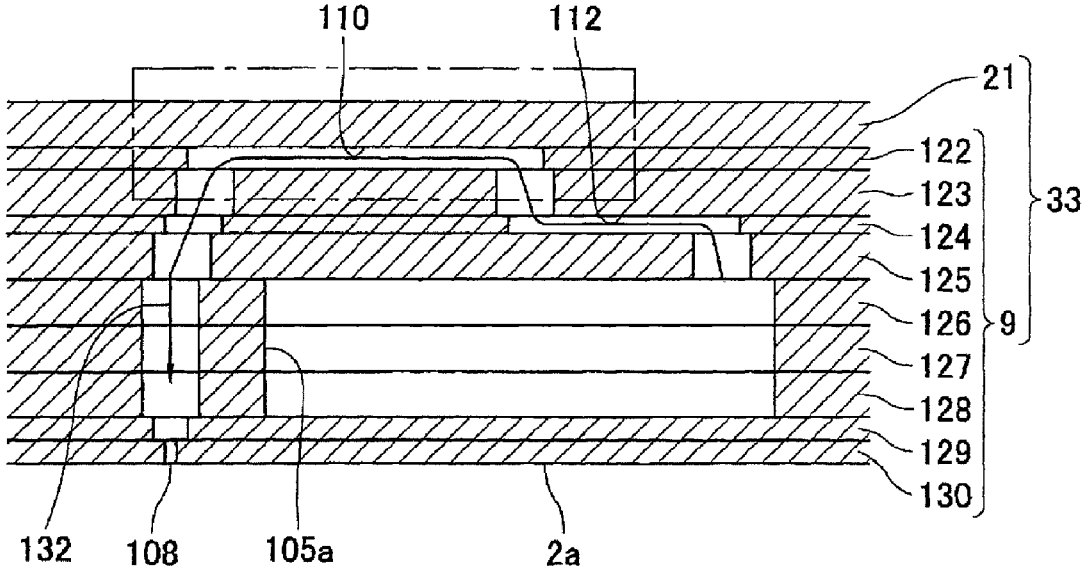
FIG. 9 is a cross sectional view taken along line IX-IX in FIG. 8.

Each of the eight actuator units 21 includes a plurality of piezoelectric actuators for giving ejection energy to the ink in respective pressure chambers 110 (FIG. 9). The COF 51 which is a flat flexible substrate is bonded to the upper surface of each actuator unit 21. On each COF 51, a driver IC 52 for generating drive signals to be supplied to the corresponding actuator unit 21 is mounted. In each driver IC 52, a temperature sensor is disposed. The filter support member 41, the laminar body 37 as the second flow-passage member including the plates 42-47 and the small-plate group 48, and the flow-passage unit 9 are stacked on one another in a direction in which the ink flows from the eighteen outflow ports to the manifolds 105, so as to provide a laminated structure.

A plurality of electronic components are disposed on the base plate 31 of the head 1. The two heaters 34, 35 and the COFs 51 are connected to the electronic components via connectors 31*a* attached to the base plate 31. The electronic components disposed on the base plate 31 are connected to the control portion 100 via wires not shown. The operations of the two heaters 34, 35 are controlled by the control portion 100. As shown in FIGS. 2 and 3, in the present embodiment, the two heaters 34, 35 have respective heating portions each as a heat element and respective temperature sensors 34*a*, 35*a* for detecting the temperature of the corresponding heating portions. Each temperature sensor 34*a*, 35*a* is constituted by a thermister as a thermoelectric element. Only when the temperature detected by the temperature sensors 34*a*, 35*a* is lower than a prescribed temperature, the heaters 34, 35 are electrified.

Figure 7:
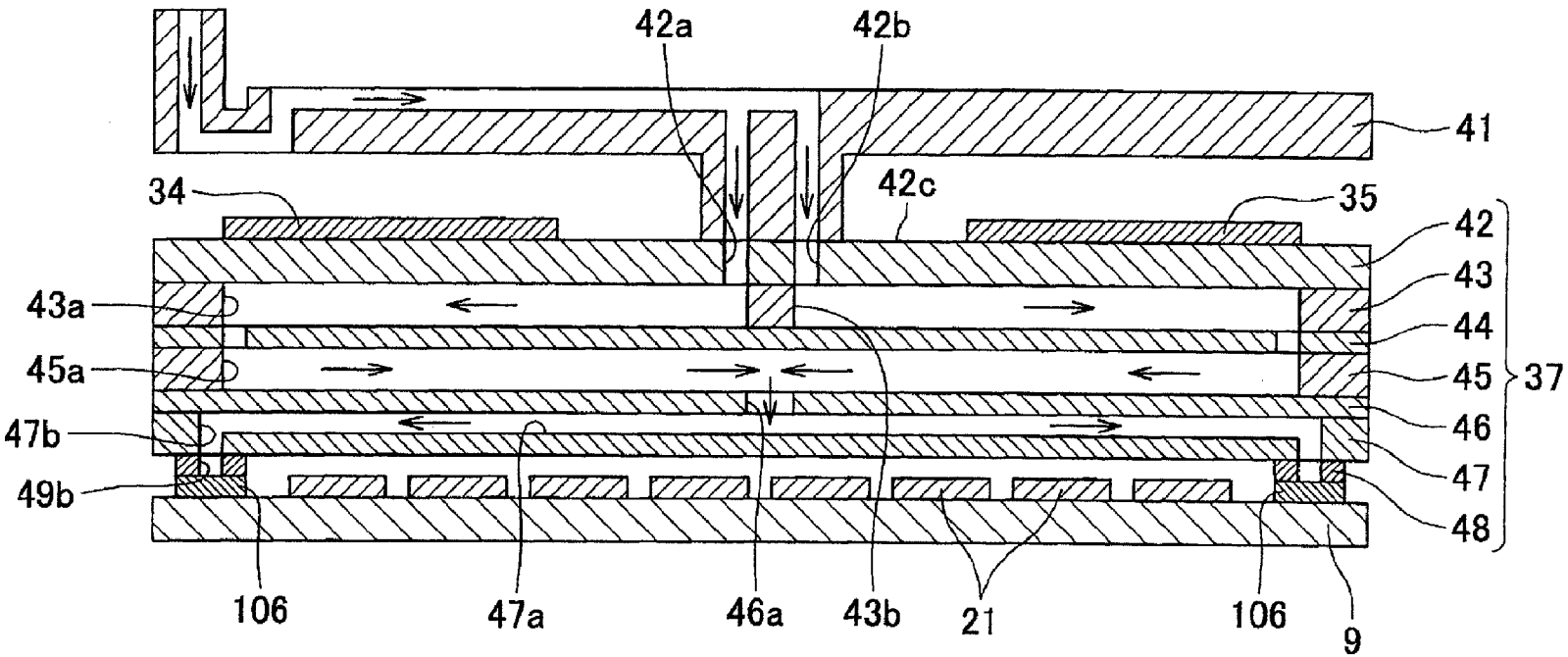
FIG. 7 is a schematic cross sectional view of the ink-jet head in its longitudinal direction.

FIG. 7 is a schematic cross sectional view of the head 1 in its longitudinal direction, in which the base plate 31 is not illustrated. In FIG. 7, the aspect ratio of each component is largely changed in order that passages can be easily visible. As shown in FIG. 7, there is formed a clearance between the facing surface 42*c* of the plate 42 and the lower surface of the filter support member 41, facilitating installation of the heaters 34, 35. The two heaters 34, 35 are fixed to the facing surface 42*c* of the plate 42 so as to be located within the clearance, without contacting the lower surface of the filter support member 41. In other words, the heaters 34, 35 are disposed between two components of the reservoir unit 32, more specifically, between the facing surface 42*c* of the plate 42 and the lower surface of the filter support member 41. According to the arrangement, a ratio of the heat that escapes to the exterior of the head 1 with respect to the heat generated by the heaters 34, 35 is made small, whereby the laminar body 37 including the plates 42-47 and the small-plate group 48 can be effectively warmed by the heat generated by the heaters 34, 35. Consequently, the ink flowing in the laminar body 37 can be effectively warmed.

The ink that has flowed from the through-holes 42*a*, 42*b* down to the openings 43*a*, 43*b* flows in the openings 43*a*, 43*b* in mutually opposite directions toward the respective longitudinal end or outer end portions of the plate 43. Each of the openings 43*a*, 43*b* is a first extending passage portion in the second liquid-supply passage extending along the facing surface 42*c* of the plate 42. The opening 43*a* is opposed to the heater 34 while the opening 43*b* is opposed to the heater 35, in the direction of lamination of the plates of the laminar body 37. As described above, in the present embodiment, the two heaters 34, 35 are disposed on the facing surface 42*c* of the plate 42, and the second liquid-supply passage has the two first extending passage portions that are opposed to the respective heaters 34, 35. Accordingly, the liquid (ink) can be effectively warmed by the two heaters 34, 35. Further, the openings 43*a*, 43*b* are passage portions that are the closest to the heaters 34, 35 in the above-indicated lamination direction, so that the ink flowing in the openings 43*a*, 43*b* can be more effectively warmed owing to the plates 42, 43, 44 that have absorbed the heat of the haters 34, 35.

The ink that has flowed from the openings 43*a*, 43*b* down to the opening 45*a* of the plate 45 via the through-holes 44*a*, 44*b* of the plate flows in the opening 45*a* in mutually opposite directions toward the center of the plate 45. The opening 45*a* includes two second extending passage portions one of which corresponds to a right half portion of the opening 45*a* and the other of which corresponds to a left half portion of the same 45*b*, as seen in FIG. 7. The two second extending passage portions extend along the facing surface 42*c* of the plate 42 and respectively overlap the openings 43*a*, 43*b* each as the first extending passage portion, as viewed in the lamination direction of the plates of the laminar body 37. The two second extending passage portions merge with each other at the upstream end of the through-hole 46*a* of the plate 46. (The upstream end of the through-hole 46*a* will be hereinafter referred to as a "merge point" where appropriate.) The ink flowing in the two second extending passage portions can be effectively warmed owing to the plates 44, 45, 46 that have absorbed the heat of the heaters 34, 35.

In the present embodiment, a resistance against a flow of the ink that flows from the inlet, i.e., the upstream end, of the through-hole 43*a* to the merge point (i.e., the upstream end of the through-hole 46*a*) is equal to a resistance of a flow of the ink that flows from the inlet, i.e., the upstream end, of the through-hole 43*b* to the merge point (i.e., the upstream end of the through-hole 46*a*. Therefore, there is not caused a difference between the amount of ink that flows in the through-hole 43*a* and the amount of ink that flows in the through-hole 43*b*, whereby it is less likely to be caused a difference in the temperature of the ink in the opening 43*a* and the temperature of the ink in the opening 43*b*, which inks are to mix with each other at the merge point. As a result, the temperature of the ink after having mixed tends to be uniform, thereby reducing a variation in the temperature of the ink that flows into the respective eighteen outflow ports. Accordingly, it is possible to minimize nonuniformity in the printed image.

In the present embodiment, the opening 45*a* has a length about twice as large as each of the openings 43*a*, 43*b*. In other words, a length of each of the two second extending passage portions from its inlet (corresponding to one longitudinal end of the opening 45*a*) to its outlet (corresponding to the central portion of the opening 45*a*) is equal to a length of the opening 43*a* or 43*b* as the first extending passage portion from its inlet (corresponding to the inner end of the opening 43*a* or 43*b*) to its outlet (corresponding to the outer end of the opening 43*a* or 43*b*). Since the second extending passage portions are long, the temperature of the ink can be easily raised by the heaters 34, 35.

The ink flow as a result of merging of the ink flows in the respective two second extending passage portions at the merge point (i.e., the upstream end of the through-hole 46*a*) drops into the recess 47*a* of the plate 47 from the downstream end of the through-hole 46*a*. Then the ink flows in the recess 47*a* and subsequently flows into the flow-passage unit 9 via the eighteen outflow ports provided by the through-holes 47*b* and the through-holes 49*a*, 49*b*. In the present embodiment, in the laminar body 37, two downstream portions which are located on the downstream side of the corresponding openings 43*a*, 43*b* merge with each other, and the eighteen outflow ports are connected to the second liquid-supply passage on the downstream side of the merge point. Accordingly, it is possible to reduce a variation in the temperature of the ink that flows into the eighteen outflow ports.

In the present embodiment, the laminar body 37 is formed of the material having heat conductivity higher than that of the material of the filter support member 41, and the two heaters 34, 35 are fixed so as to be in contact with the facing surface 42*c* of the plate 42. Accordingly, the heat generated by the two heaters 34, 35 can be efficiently transmitted to the ink. Moreover, the temperature sensors 34*a*, 35*a* are integrally disposed on the respective heaters 34, 35, so that it is possible to directly detect, without delay, changes in the temperature of the plates 42 and so on that are caused by the heat generated by the heaters 34, 35.

Figure 8:
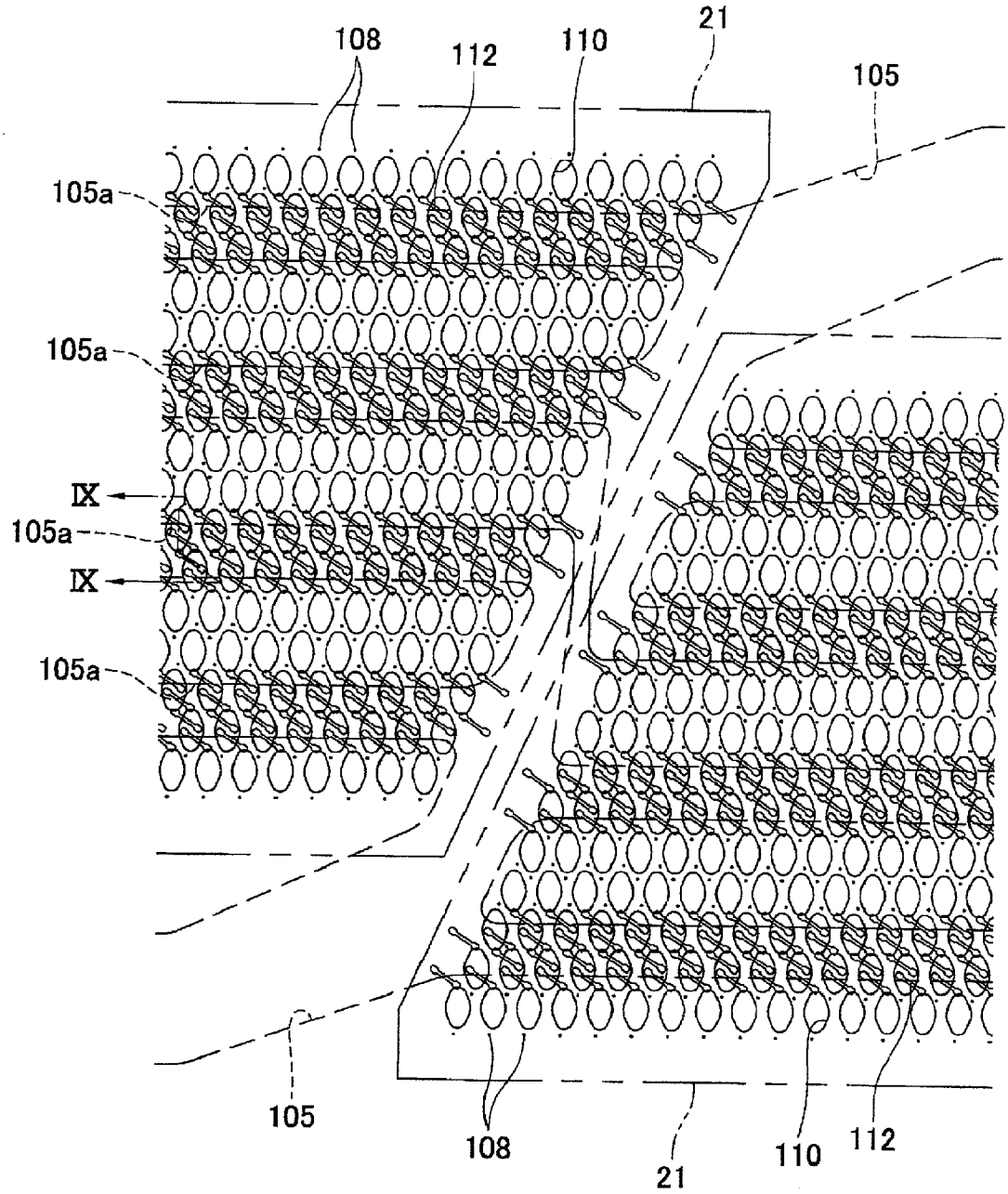
FIG. 8 is an enlarged plan view of a part of a flow-passage unit included in the ink-jet head.
Figure 10A:
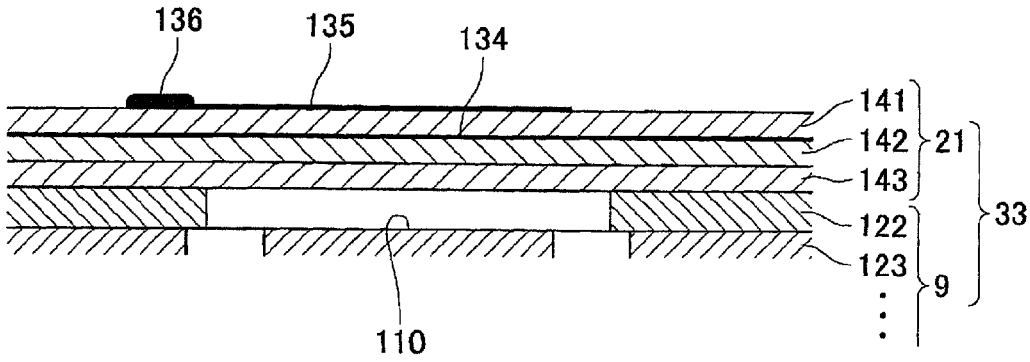
FIG. 10A is an enlarged cross sectional view of the actuator unit and FIG. 10B is a plan view of an individual electrode.
Figure 10B:
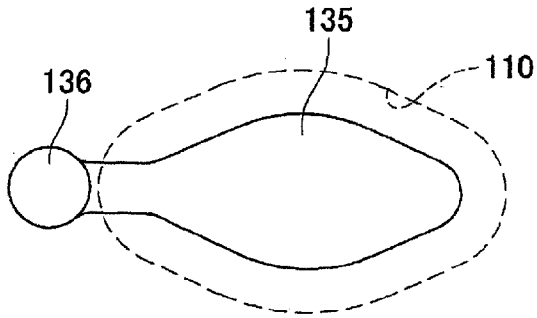

Referring next to FIGS. 8, 9, 10A, and 10B, the head main body 33 will be explained in detail. FIG. 8 is a plan view showing a part of two adjacent actuator units 21. FIG. 9 is a partial cross sectional view of the flow-passage unit 9 along line IX-IX in FIG. 8. FIG. 10A is an enlarged cross sectional view of an area enclosed by the dashed line in FIG. 9 and FIG. 10B is a plan view of an individual electrode. In FIG. 8, apertures 112 that should be indicated by a broken line are indicated by a solid line for easier understanding.

As shown in FIG. 8, a plurality of pressure chambers 110 each having a generally rhombic shape are regularly disposed in a matrix on the upper surface of the flow-passage unit 9. Each actuator unit 21 includes a plurality of individual electrodes 135 (FIG. 10A) disposed so as to be respectively opposed to the plurality of pressure chambers 110 formed in the flow-passage unit 9. The actuator unit 21 has a function of selectively giving ejection energy to the ink in the pressure chambers 110.

The ink supply holes 105*b* (FIG. 5) are open to the upper surface of the flow-passage unit 9 so as to respectively correspond to the eighteen outflow ports of the reservoir unit 32. The ink supply holes 105*b* are covered with corresponding filters 106 each having a smaller mesh size than the filter 79. In the flow-passage unit 9, there are formed: a plurality of manifolds 105 each extending from a corresponding one of the ink supply holes 105*b*; and a plurality of sub manifolds 105*a*, each as a common liquid passage, which are branched from corresponding manifolds 105. On the lower surface of the flow-passage unit 9, the ejection surfaces 2*a* are arranged in each of which a plurality of ejection holes 108, each as a nozzle opening, are regularly arranged in matrix.

As shown in FIG. 9, the flow-passage unit 9 is constituted by nine metal plates including a cavity plate 122, a base plate 123, an aperture plate 124, a supply plate 125, three manifold plates 126, 127, 128, a cover plate 129, and a nozzle plate 130, which are arranged in this order from the top of the flow-passage unit 9. Each of the nine plates 122-130 has a rectangular shape in plan view which is long in the main scanning direction.

The nine plates 122-130 are positioned with and stacked on each other, whereby a plurality of individual ink passages 132 as a plurality of individual liquid passages are defined in the flow-passage unit 9 each of which extends from an outlet of a corresponding one of the sub manifolds 105*a* to a corresponding one of the ejection holes 108 via a corresponding one of the pressure chambers 110. The ink which has supplied from the reservoir unit 32 to the flow-passage unit 9 via the ink supply holes 105*b* flows into the sub manifolds 105*a* from the manifolds 105. The ink in the sub manifolds 105*a* flows into the individual ink passages 132 and reaches nozzle ejection holes 108 via the apertures 112 each functioning as an orifice and the pressure chambers 110.

The actuator unit 21 will be explained. As shown in FIG. 5, the eight actuator units 21 each having a trapezoidal shape in plan view are arranged in a zigzag fashion in the longitudinal direction of the flow-passage unit 9 so as to avoid the ink supply holes 105*b*. Parallel facing sides (short and long sides) of each actuator unit 21 are parallel to the longitudinal direction of the flow-passage unit 9, and oblique sides of neighboring two actuator units 21 partially overlap as viewed in the longitudinal direction of the flow-passage unit 9, namely, in the main scanning direction, as shown in FIG. 8.

As shown in FIG. 10A, each actuator unit 21 includes three piezoelectric layers 141-143 formed of a ceramic material of lead zirconate titanate (PZT) having ferroelectricity. The individual electrodes 135 are formed on respective regions of the uppermost piezoelectric layer 141 that correspond to the pressure chambers 110. A common electrode 134 is provided on an interface between the uppermost piezoelectric layer 141 and the piezoelectric layer 142 located under the layer 141. As shown in FIG. 10B, each individual electrode 135 has a generally rhombic shape in plan view similar to the pressure chamber 110. One acute end portion of the individual electrode 135 extends beyond the pressure chamber 110, and a circular land 136 is formed at the acute end portion for electrical connection with the individual electrode 135. In addition to the lands 136 for the individual electrodes 135, a land for the common electrode 134 is formed on the upper surface of the piezoelectric layer 141. The land for the common electrode 134 is connected to the common electrode 134 via the conductive material in through-holes.

The common electrode 134 is kept at a ground potential as a basic potential given by the COF 51. The individual electrodes 135 are electrically connected to terminals of the driver IC 52 via the respective lands 136 and respective internal wires of the COF 51. A drive signal for driving the actuator unit 21 is supplied from the driver IC 52 to the individual electrodes 135 independently of each other. Accordingly, respective portions in the actuator unit 21 sandwiched by and between the individual electrodes 135 and the pressure chambers 110 function as individual actuators which are independent of each other. That is, a plurality of actuators, each as an energy giving member, are provided in the actuator unit 21 in the same number as the pressure chambers 110.

There will be next explained a method of driving each actuator unit 21 to permit ink droplets to be ejected from the nozzles. The piezoelectric layer 141 is polarized in its thickness direction. When an electric field is applied to the piezoelectric layer 141 in the polarization direction with one individual electrode 135 kept at a potential different from that of the common electrode 134, a portion of the piezoelectric layer 141 to which the electric field is applied functions as an active portion that undergoes strain owing to a piezoelectric effect. The active portion expands in a direction of thickness of the layer 141 and contracts in a direction parallel to the plane of the layer 141 (i.e., in the plane direction) when the electric field and the polarization are in the same direction. In this instance, the amount of deformation of the active portion upon expansion and contraction is larger in the plane direction than in the thickness direction. In the actuator unit 21, the uppermost one 141 of the three piezoelectric layers that is the most distant from the pressure chambers 110 is an active layer including the active portions while the lower two piezoelectric layers 142, 143 nearer to the pressure chambers 110 are non-active layers. As shown in FIG. 10A, the piezoelectric layer 143 is fixed to the upper surface of the cavity plate 122 that defines the pressure chambers 110. Accordingly, when there is generated a difference in strain in the plane direction between the portion of the piezoelectric layer 141 to which the electric field is applied and the piezoelectric layers 142, 143 located under the layer 141, the entirety of the piezoelectric layers 141-143 deforms into a convex shape that protrudes toward the pressure chamber 110 (unimorph deformation). Accordingly, the pressure (ejection energy) is given to the ink in the pressure chamber 110, so that there is generated a pressure wave in the pressure chamber 110. The generated pressure chamber propagates from the pressure chamber 110 to the ejection hole 108 of the corresponding nozzle, whereby the ink droplets are ejected from the ejection hole 108.

In the illustrated embodiment, the ink that flows in the laminar body 37 can be effectively warmed by the heaters 34, 35 disposed between the facing surface 42*c* of the plate 42 and the lower surface of the filter support member 41. Accordingly, the viscosity of the ink in each head 1 can be sufficiently lowered. Hence, even under the low temperature condition, the resistance against the flow of the ink at a time when the ink flows into the pressure chamber 110 does not become high, so that increasing the drive frequency becomes effective for obtaining a satisfactory ejection effect.

Further, the same ejection characteristic as obtained under the ordinary temperature condition can be obtained under the low temperature condition without increasing the drive voltage, so that it is not required to increase the withstand voltage of the actuator units 21 and the withstand voltage of the driver ICs 52 configured to drive the actuator units 21.

It is to be understood that the invention is not limited to the details of the illustrated embodiment, but may be embodied with various changes and modifications, which may occur to those skilled in the art, without departing from the spirit and scope of the invention defined in the attached claims. For instance, the heaters 34, 35 may be disposed on the lower surface of the filter support member 41. Only one heater or more than three heaters may be used. Only one through-hole may be formed in the plate 42. Only one opening may be formed in the plate 43. Two openings may be formed in the plate 45. Only one common liquid passage may be formed in the flow-passage unit 9. The passage structure in the head 1 is not limited to that in the illustrated embodiment, but may be otherwise modified. The energy giving member is not limited to the one utilizing the piezoelectric body, but the one of a thermal type may be utilized.

It is to be understood that the principle of the invention may be applicable not only to the head for a line printer as in the illustrated embodiment, but also to a head for a serial printer, and further to a head for ejecting a liquid other than the ink.

What is claimed is:

1. A liquid ejecting head for ejecting a liquid from a plurality of ejection holes, comprising:

a first flow-passage member in which is formed a first liquid-supply passage to which the liquid is supplied from an exterior of the liquid ejecting head;

a second flow-passage member in which is formed a second liquid-supply passage connected to the first liquid-supply passage and which has a plurality of outflow ports for dispensing the liquid from the second liquid-supply passage;

a third flow-passage member in which are formed (a) at least one common liquid passage each communicating with at least one of the plurality of outflow ports of the second flow-passage member and (b) a plurality of individual liquid passages which are provided so as to respectively correspond to the plurality of ejection holes, each of which is connected to any one of the at least one common liquid passage, and which respectively have pressure chambers formed therein, each of the plurality of individual liquid passages introducing the liquid to a corresponding one of the plurality of ejection holes via a corresponding one of the pressure chambers; and at least one energy giving member configured to give ejection energy to the liquid in each of the pressure chambers that are formed respectively in the plurality of individual liquid passages, wherein the first flow-passage member, the second flow-passage member, and the third flow-passage member are superposed in this order on each other, and wherein the liquid ejecting head further comprises a heater disposed between one surface of the first flow-passage member that faces the second flow-passage member and facing surface of the second flow-passage member as one surface thereof that faces the first flow-passage member.

2. The liquid ejecting head according to claim 1, wherein the second liquid-supply passage has a first extending passage portion that extends along the facing surface.

3. The liquid ejecting head according to claim 2, wherein the second flow-passage member has a laminar structure composed of a plurality of plates, and wherein the first extending passage portion is provided by an opening which is formed through a thickness of one of the plurality of plates that is located intermediate among the plurality of plates in a direction of lamination of the laminar structure.

4. The liquid ejecting head according to claim 2, wherein the second liquid-supply passage has a second extending passage portion which communicates with the first extending passage portion on a downstream side of the first extending passage portion and which extends along the facing surface so as to overlap the first extending passage portion as viewed in a direction perpendicular to the facing surface.

5. The liquid ejecting head according to claim 4, wherein the second flow-passage member has a laminar structure composed of a plurality of plates, and wherein the first extending passage portion is provided by an opening which is formed through a thickness of one of the plurality of plates that is located intermediate among the plurality of plates in a direction of lamination of the laminar structure, and the second extending passage portion is provided by an opening which is formed through a thickness of another one of the plurality of plates that is located intermediate among the plurality of plates in the direction of lamination of the laminar structure and that cooperates with said one of the plurality of plates to sandwich at least one of the plurality of plates therebetween.

6. The liquid ejecting head according to claim 2, wherein the second liquid-supply passage has two first extending passage portions each as the first extending passage portion.

7. The liquid ejecting head according to claim 6, comprising two heaters each as the heater, the two heaters being disposed so as to be opposed respectively to the two first extending passage portions in a direction perpendicular to the facing surface.

8. The liquid ejecting head according to claim 6, wherein the two first extending passage portions have the same length as measured in a direction of extension thereof.

9. The liquid ejecting head according to claim 6, wherein the second flow-passage member has an elongate shape extended in one direction, and wherein a direction of extension of each of the two first extending passage portions coincides with said one direction, and the two first extending passage portions are arranged in said one direction.

10. The liquid ejecting head according to claim 9, wherein the second liquid-supply passage is configured such that the liquid flowing in one of the two first extending passage portions flows in a direction away from the other of the two first extending passage portions.

11. The liquid ejecting head according to claim 9, wherein the two first extending passage portions are provided so as to be symmetric with respect to a plane that includes a center of the second flow-passage member in said one direction and that is perpendicular to the one direction.

12. The liquid ejecting head according to claim 9, comprising two heaters each as the heater, wherein the two heaters are disposed so as to be opposed respectively to the two first extending passage portions in a direction perpendicular to the facing surface, and a midpoint of a distance by which the two heaters are spaced apart from each other coincides with a center of the second flow-passage member in said one direction.

13. The liquid ejecting head according to claim 6, wherein the second liquid-supply passage has two downstream portions each of which is disposed on a downstream side of a corresponding one of the two first extending passage portions so as to communicate therewith and which merge with each other, and wherein the plurality of outflow ports are disposed more downstream than a merge point at which the two downstream portions merge with each other.

14. The liquid ejecting head according to claim 13, wherein a resistance against a flow of the liquid flowing in one of the two first extending passage portions and one of the two downstream portions connected to said one of the two first extending passage portions and reaching the merge point is equal to a resistance against a flow of the liquid flowing in the other of the two first extending passage portions and the other of the two downstream portions connected to the other of the two first extending passage portions and reaching the merge point.

15. The liquid ejecting head according to claim 13, wherein the two downstream portions function as respective second extending passage portions which are provided so as to respectively correspond to the two first extending passage portions and which extend along the facing surface so as to respectively overlap the two first extending passage portions as viewed in a direction perpendicular to the facing surface.

16. The liquid ejecting head according to claim 15, wherein each of the two second extending passage portions has a length as measured in a direction of extension thereof that is equal to a length of a corresponding one of the two first extending passage portions as measured in the direction.

17. The liquid ejecting head according to claim 15, wherein the second flow-passage member has a laminar structure composed of a plurality of plates, and wherein each of the two first extending passage portions is provided by an opening which is formed through a thickness of one of the plurality of plates that is located intermediate among the plurality of plates in a direction of lamination of the laminar structure, and each of the two second extending passage portions is provided by an opening which is formed through a thickness of another one of the plurality of plates that is located intermediate among the plurality of plates in the direction of lamination of the laminar structure and that cooperates with said one of the plurality of plates to sandwich at least one of the plurality of plates therebetween.

18. The liquid ejecting head according to claim 1, wherein the heater is disposed so as to be in contact with the second flow-passage member.

19. The liquid ejecting head according to claim 18, wherein the second flow-passage member is formed of a material having a higher degree of heat conductivity than a material of the first flow-passage member.

20. The liquid ejecting head according to claim 18, wherein the heater is disposed so as not to be in contact with the first flow-passage member.

21. The liquid ejecting head according to claim 1, wherein a clearance is provided between said one surface of the first flow-passage member that faces the second flow-passage member and the facing surface of the second flow-passage member that faces the first flow-passage member.

22. The liquid ejecting head according to claim 21, wherein the hearer is disposed in the clearance.

* * * * *